US012326149B2

(12) United States Patent
Yoshida et al.

(10) Patent No.: US 12,326,149 B2
(45) Date of Patent: Jun. 10, 2025

(54) ROTARY COMPRESSOR

(71) Applicant: Panasonic Intellectual Property Management Co., Ltd., Kadoma (JP)

(72) Inventors: Hirofumi Yoshida, Shiga (JP); Akifumi Hyodo, Osaka (JP); Yusuke Imai, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 18/832,318

(22) PCT Filed: Aug. 29, 2022

(86) PCT No.: PCT/JP2022/032359
§ 371 (c)(1),
(2) Date: Jul. 23, 2024

(87) PCT Pub. No.: WO2023/139829
PCT Pub. Date: Jul. 27, 2023

(65) Prior Publication Data

US 2025/0116273 A1 Apr. 10, 2025

(30) Foreign Application Priority Data

Jan. 24, 2022 (JP) ..... 2022-008476

(51) Int. Cl.
*F04C 29/06* (2006.01)
*F04C 18/356* (2006.01)

(52) U.S. Cl.
CPC ..... *F04C 29/06* (2013.01); *F04C 18/3564* (2013.01)

(58) Field of Classification Search
CPC ..... F04C 29/06; F04C 18/3564
See application file for complete search history.

(56) References Cited

U.S. PATENT DOCUMENTS 8,790,097 B2 * 7/2014 Yokoyama ..... F04C 29/065 418/5
9,568,004 B2 * 2/2017 Ogata ..... F04C 29/026
(Continued)

FOREIGN PATENT DOCUMENTS

CN 1601110 A * 3/2005
JP 2003-129958 A 5/2003
(Continued)

OTHER PUBLICATIONS

International Search Report and Written Opinion, International Patent Application No. PCT/JP2022/032359, Oct. 11, 2022, with English translation of Search Report (9 pages).

*Primary Examiner* — Jesse S Bogue
(74) *Attorney, Agent, or Firm* — HSML P.C.

(57) ABSTRACT

A rotary compressor 100 includes a drive shaft 101 having an eccentric shaft 101*a*, a piston 102 fitted onto the eccentric shaft 101*a*, a cylinder 103 that receives the eccentrically rotating piston 102, an upper end plate 104 and a lower end plate 105 that close the upper and lower opening surfaces of the cylinder 103, a vane 106 that divides a space formed by the cylinder 103, the piston 102, the upper end plate 104, and the lower end plate 105 into a suction chamber 113 and a compression chamber 114, a discharge space 117 that is formed by causing the cover 108 to close a recessed portion 107 obtained by recessing a surface of either the upper end plate 104 or the lower end plate 105 on the opposite side to the cylinder 103 and where discharge gas flows in from the compression chamber 114 and directly flows out to the outside of the compressor 100, and spatial volume of the discharge space 117 having 10 times enclosed volume of the cylinder 103, thereby reducing noise and vibration due to discharge pulsation as well as improving efficiency and reliability and reducing cost.

4 Claims, 6 Drawing Sheets

(56) References Cited

U.S. PATENT DOCUMENTS

| | | | | |
|---|---|---|---|---|
| 12,044,224 | B2 * | 7/2024 | Park | F04C 29/028 |
| 2005/0069423 | A1 * | 3/2005 | Ebara | F04C 23/001 417/313 |

FOREIGN PATENT DOCUMENTS

| | | | | | |
|---|---|---|---|---|---|
| JP | 2005-113878 | A | | 4/2005 | |
| JP | 2005098663 | A | * | 4/2005 | |
| JP | 2010209865 | A | * | 9/2010 | |
| JP | 6835272 | B1 | * | 2/2021 | F04C 18/3564 |

* cited by examiner

[Fig. 1]
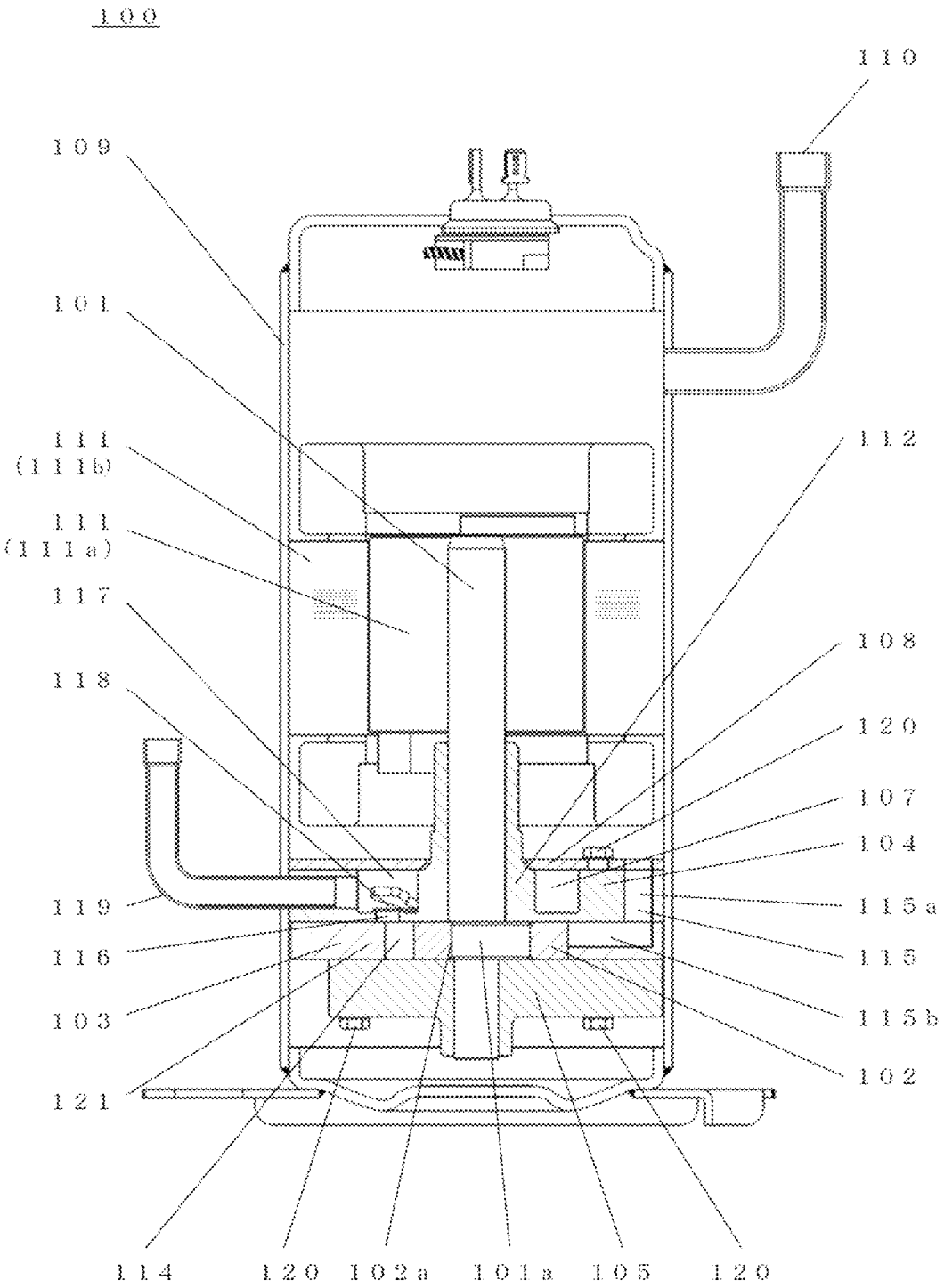

[Fig. 2]
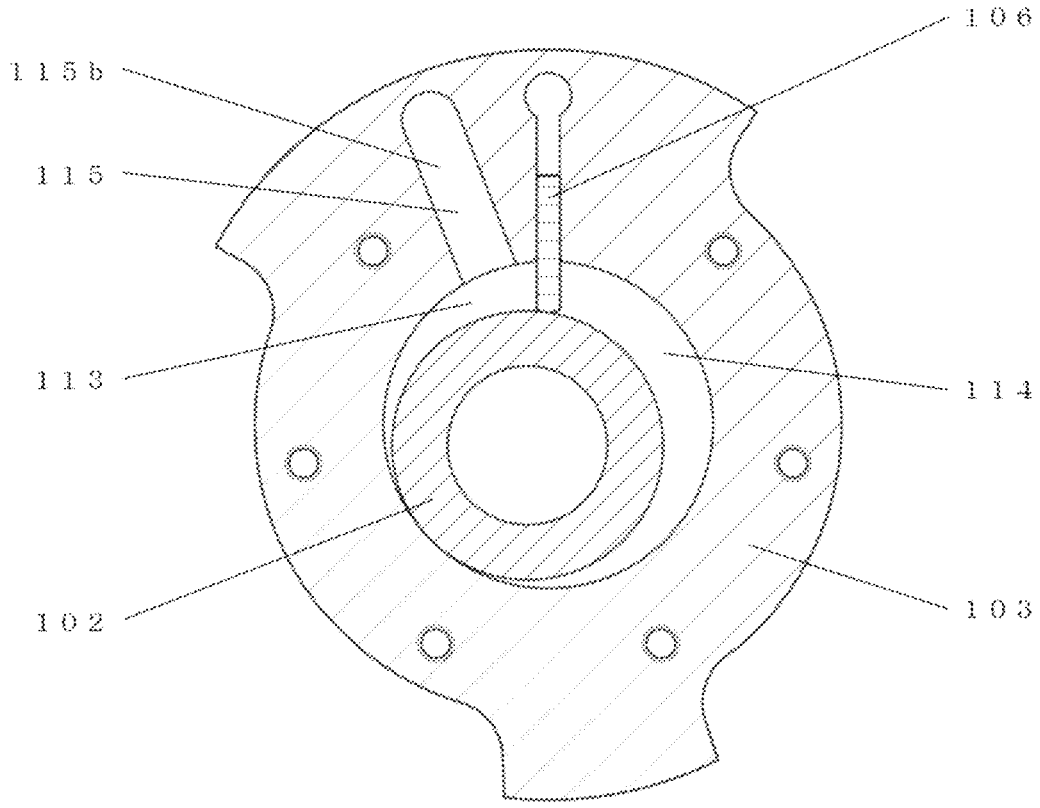

[Fig. 3]
104
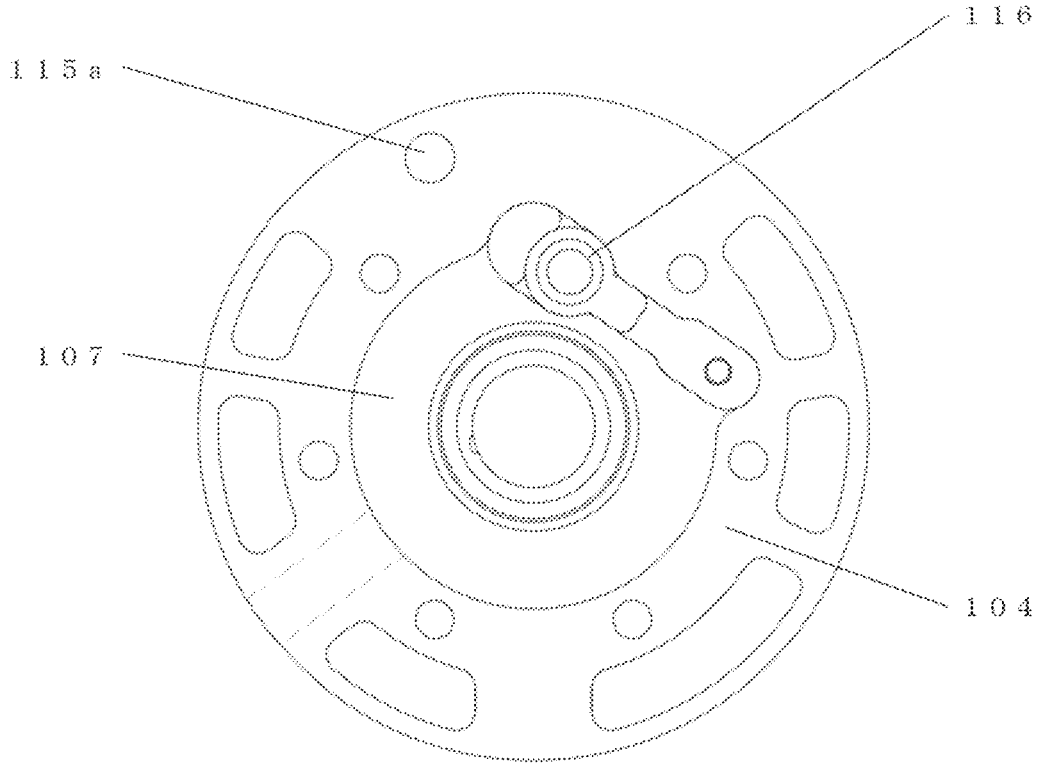

[Fig. 4]
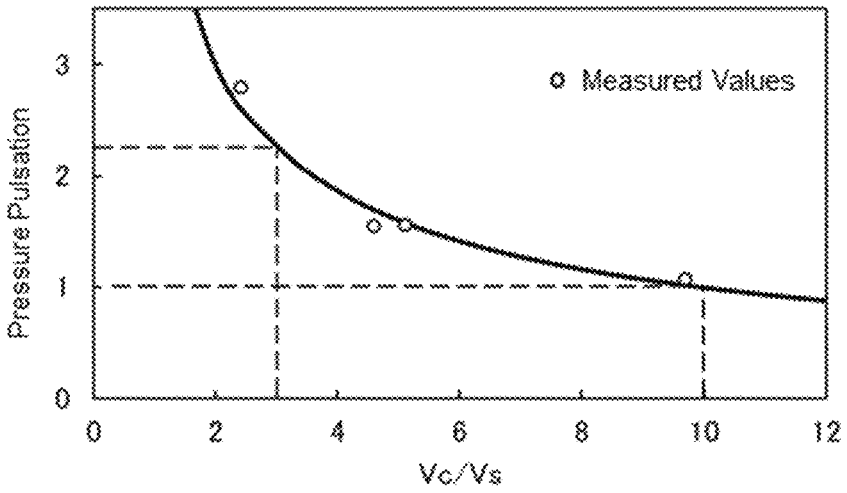

[Fig. 5]
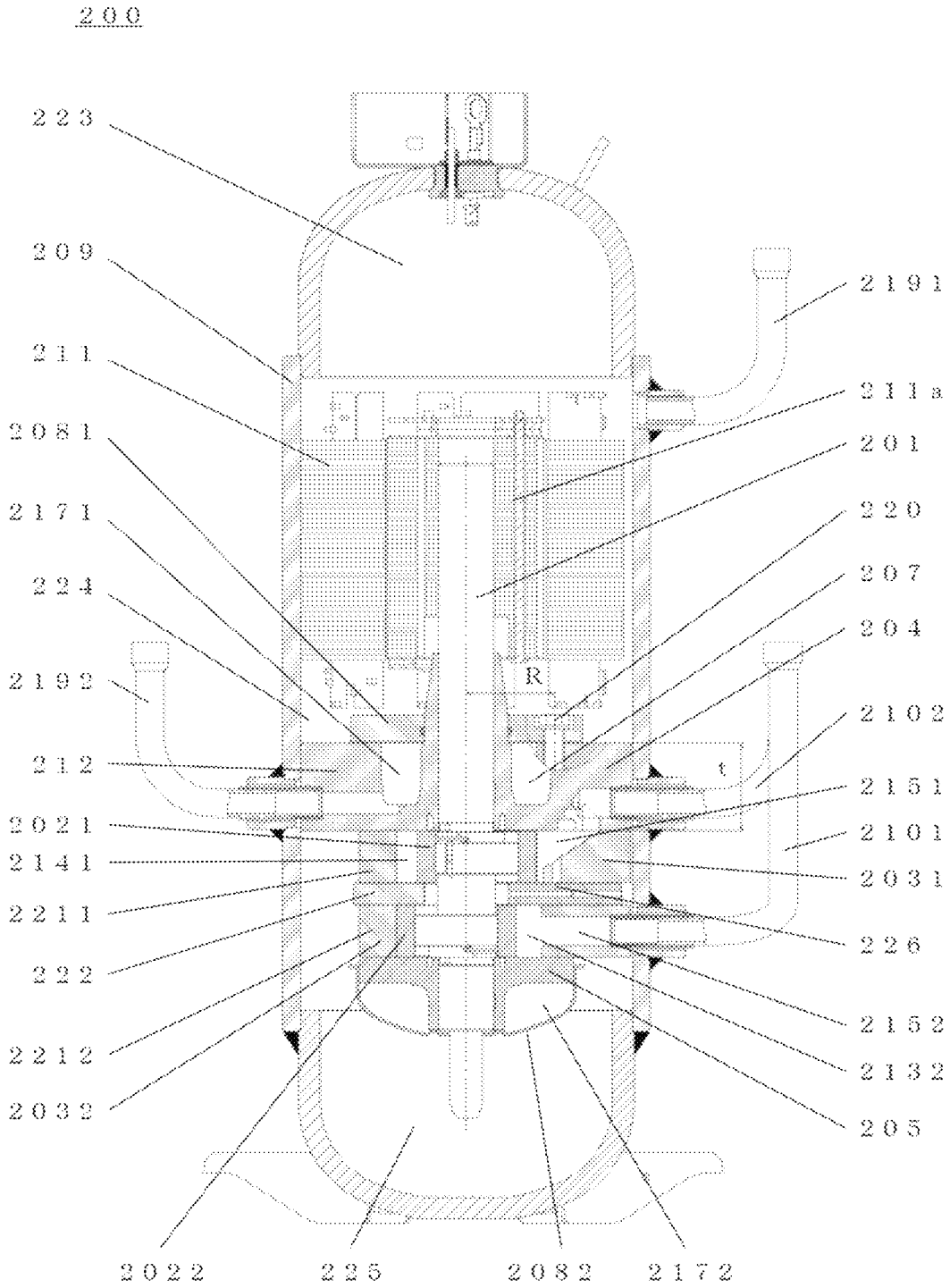

[Fig. 6]
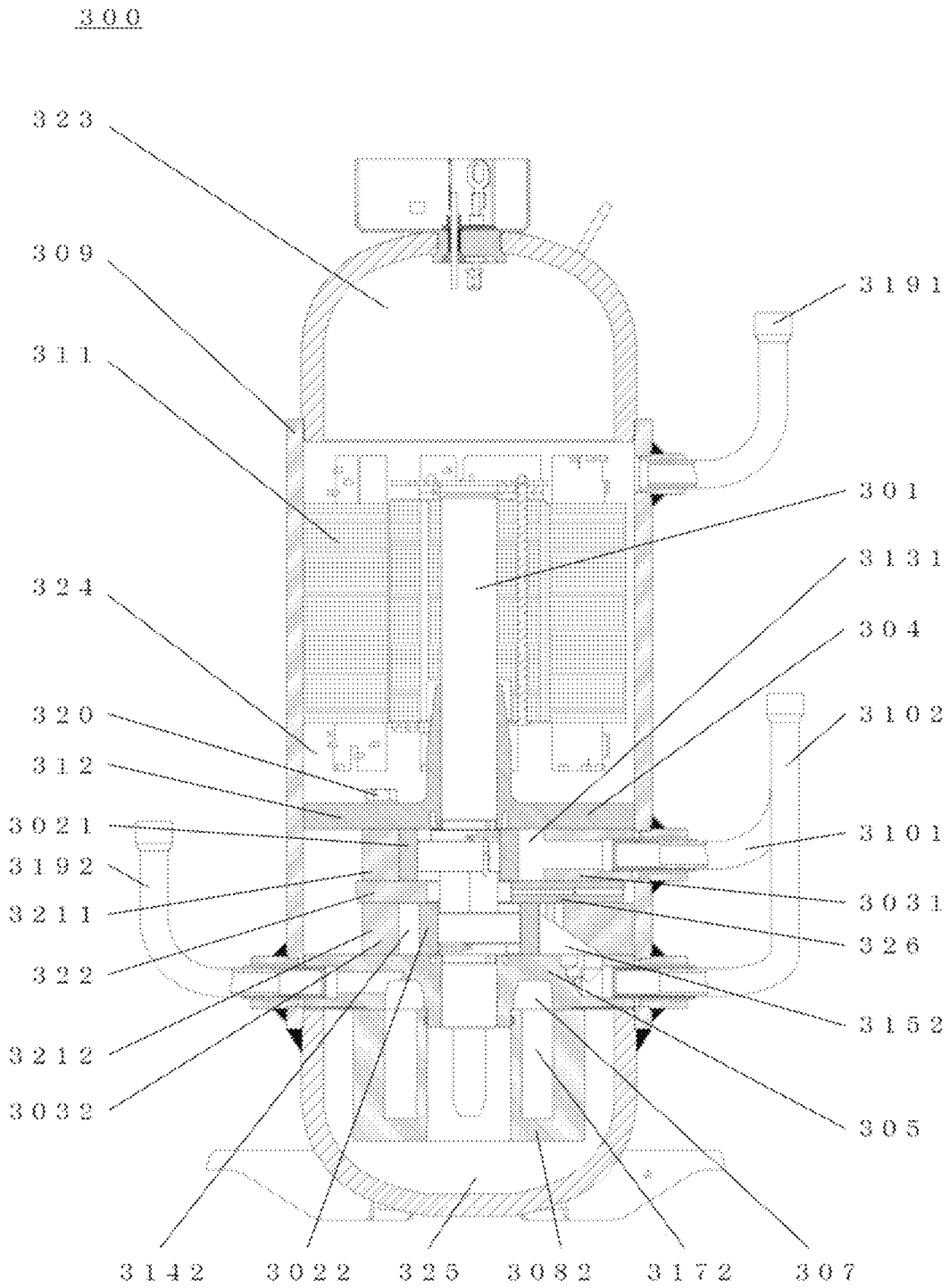

ROTARY COMPRESSOR

TECHNICAL FIELD

The present disclosure relates to a rotary compressor used in an air conditioner, a refrigerator, a water heater, etc.

BACKGROUND TECHNIQUE

Patent Document 1 discloses a rotary compressor that aims to reduce noise and vibration caused by discharge pulsation of refrigerant. This rotary compressor includes a cylinder, a supporting member having a bearing, a discharge muffling chamber formed in the supporting member and consisting of a plurality of divided chambers and a passage communicating these chambers, and refrigerant inflow units and refrigerant outflow units provided respectively in the divided chambers at both ends.

PRIOR ART DOCUMENT

Patent Document

Patent Document 1

Japanese Patent Application Laid-open No. 2003-129958

SUMMARY OF THE INVENTION

Problem to be Solved by the Invention

The present disclosure provides a rotary compressor that reduces noise and vibration caused by discharge pulsation while improving efficiency and reliability and reducing cost.

Means for Solving the Problem

A rotary compressor of the present disclosure includes a drive shaft having an eccentric shaft, a piston fitted onto the eccentric shaft, a cylinder that accommodates the eccentrically rotating piston, an upper end plate and a lower end plate that close upper and lower opening surfaces of the cylinder, a vane that divides a space formed by the cylinder, the piston, the upper end plate, and the lower end plate into a suction chamber and a compression chamber, and a discharge space that is formed by causing a cover to close a recessed portion obtained by recessing a surface of either the upper end plate or the lower end plate on an opposite side to the cylinder and where discharge gas flows in from the compression chamber and directly flows out to outside of the compressor. Spatial volume of the discharge space is set to 3 to 10 times enclosed volume of the cylinder.

Effect of the Invention

The rotary compressor of the present disclosure can suppress pressure pulsation by increasing the discharge space. At the same time, it is not necessary for the discharge space to have a complex shape, and the sufficiently wide discharge space can suppress pressure loss of the discharge gas. In addition, the discharge space is composed of the recessed portion, and the total height of the upper end plate or lower end plate including the cover is suppressed. By doing so, an electric motor can be fixed closer to the cylinder side, which can contribute to reducing the deflection of the drive shaft during operation, miniaturizing the compressor, and improving efficiency by increasing the thickness of the electric motor. Therefore, low noise, low vibration, high efficiency, high reliability, and low cost can be simultaneously realized.

BRIEF DESCRIPTION OF THE DRAWINGS

FIG. 1 is a vertical cross-sectional view of a rotary compressor according to the first embodiment;

FIG. 2 is a lateral cross-sectional view of a compression mechanism according to the first embodiment;

FIG. 3 is a front view of an upper bearing according to the first embodiment;

FIG. 4 is a graph showing a change in pressure pulsation with respect to Vc/Vs;

FIG. 5 is a vertical cross-sectional view of a rotary compressor according to a second embodiment; and FIG. 6 is a vertical cross-sectional view of a rotary compressor according to a third embodiment.

MODE FOR CARRYING OUT THE INVENTION

Hereinafter, embodiments will be described in detail with reference to the drawings. However, detailed descriptions more than necessary may be omitted. For example, detailed descriptions of well-known matters or redundant descriptions of substantially the same configurations may be omitted. This is to avoid unnecessarily redundant explanations and facilitate understanding by those skilled in the art.

The accompanying drawings and the following description are provided for thorough understanding of the present disclosure by those skilled in the art and are not intended to limit the subject matter described in the claims.

First Embodiment

A first embodiment will be described below using FIGS. 1 to 4.

[1-1. Configuration]

As shown in FIGS. 1 to 3, a rotary compressor 100 includes a drive shaft 101, a piston 102, a cylinder 103, an upper bearing 104, a lower bearing 105, a vane 106, a recessed portion 107, and a cover 108.

FIG. 1 is a vertical cross-sectional view of the rotary compressor 100. An entire interior of a hermetic container 109 is an suction pressure atmosphere communicating with a suction pipe 110. An electric motor 111 is accommodated in a central portion of the hermetic container 109, and a compression mechanism 112 is accommodated in a lower portion thereof. The compression mechanism 112 is driven by the drive shaft 101 fixed to a rotor 111*a* of the electric motor 111.

FIG. 2 is a lateral cross-sectional view of the compression mechanism 112 viewed from the upper bearing 104 side, showing only the piston 102, the cylinder 103, and the vane 106. FIG. 3 is a front view of the upper bearing 104.

In the compression mechanism 112, the cylinder 103, the piston 102, and the vane 106 are sandwiched between the upper bearing 104 and the lower bearing 105 supporting the drive shaft 101. A space formed between the cylinder 103 and the piston 102 is divided by the vane 106 to form a suction chamber 113 and a compression chamber 114. In this way, the compression mechanism 112 performs a compression operation. The cylinder 103 accommodates an eccentric shaft 101*a* integrally formed with the drive shaft 101, and the piston 102 is rotatably attached to this eccentric shaft 101*a*.

A suction passage 115 is formed by an axial vertical hole 115*a* provided in the upper bearing 104 and a groove 115*b* provided in the cylinder 103, and the suction passage 115 communicates with the suction chamber 113. The upper bearing 104 is provided with the recessed portion 107 and a discharge hole 116. A discharge space 117 formed by closing the recessed portion 107 with the cover 108 communicates with the compression chamber 114 through the discharge hole 116 equipped with a check valve 118. A discharge pipe 119 is inserted around periphery of the upper bearing 104 penetrating through the hermetic container 109 and the upper bearing 104, and the discharge pipe 119 communicates with the discharge space 117. The cover 108 partitions low-temperature and low-pressure suction gas inside the hermetic container 109 and high-temperature and high-pressure discharge gas inside the discharge space 117. The cover 108, the upper bearing 104, the cylinder 103, and the lower bearing 105 are fastened in the axial direction by a plurality of fastening bolts 120. A volume of the discharge space 117 has 3 to 10 times enclosed volume of the cylinder 103.

[1-2. Operation]

An operation of the rotary compressor 100 configured as above will be described below.

[1-2-1. Compression Operation]

A compression operation of the rotary compressor 100 will be described based on FIGS. 1 and 2.

When the electric motor 111 is energized and the drive shaft 101 rotates, the eccentric shaft 101*a* eccentrically rotates in the cylinder 103, and the piston 102 rotationally moves while contacting the vane 106, thus, repeating suction and compression of the working fluid.

Gas is sucked into the suction chamber 113 through the suction pipe 110, the internal space of the hermetic container 109, and the suction passage 115. The low-temperature and low-pressure suction gas is compressed by a compression element 121 consisting of the piston 102, the cylinder 103, the upper bearing 104, the lower bearing 105, and the vane 106. The compressed high-temperature and high-pressure discharge gas is discharged into the discharge space 117 from the discharge hole 116 through the check valve 118, and then discharged from the rotary compressor 100 through the discharge pipe 119.

When the pressure in the compression chamber 114 reaches the pressure in the discharge space 117, the check valve 118 opens, and the discharge gas is discharged into the discharge space 117, the pressure in the discharge space 117 increases. When the discharge from the compression chamber 114 to the discharge space 117 is completed, the check valve 118 closes, and the pressure in the discharge space 117 decreases. In this way, pressure pulsation occurs in the discharge space 117 in accordance with the opening and closing operation of the check valve 118.

[1-2-2. Oil Supply Operation]

Oil is stored in the lower part of the hermetic container 109. Normally, up to the upper end height of the cylinder 103 of the compression mechanism 112 inside the hermetic container 109 is immersed in the oil. An oil passage (not shown) is provided in the axial direction inside the drive shaft 101, and the oil is pumped up from the lower end of the oil passage by an oil pump mechanism. While the oil passes through an oil supply hole (not shown) provided in the eccentric shaft 101*a*, and lubricates a sliding portion of the eccentric shaft 101*a*, the oil reaches an inner periphery 102*a* of the piston 102. After that, one part of the oil lubricates a journal bearing sliding portion of the upper bearing 104 and the lower bearing 105 and is discharged outside the compression mechanism 112. The other part of the oil passes through a small axial gap between the upper and lower end faces of the piston 102 and the upper bearing 104 and the lower bearing 105 while lubricating them and is supplied to the suction chamber 113. Even after the suction chamber 113 becomes the compression chamber 114 that does not communicate with the suction passage 115, the oil inside the suction chamber 113 is discharged from the discharge hole 116 together with the gas while sealing each gap of the compression chamber 114. After that, the oil is discharged from the rotary compressor 100 through the discharge pipe 119 together with the gas flow described above. The oil that flows out into the refrigeration cycle is separated from the gas by an oil separator and liquefied into droplets, and then returned to the hermetic container 109. In the case of a refrigeration cycle without an oil separator, the oil flows into the inside of the hermetic container 109 together with the suction gas, is separated from the gas and liquefied before reaching the suction passage 115, and returns to the lower part of the hermetic container 109 by gravity.

[1-3. Effect and the Like]

As described above, according to present embodiment, the rotary compressor 100 includes the drive shaft 101, the piston 102, the cylinder 103, the upper bearing 104, the lower bearing 105, the vane 106, and the discharge space 117. The drive shaft 101 has the eccentric shaft 101*a*. The piston 102 is fitted onto the eccentric shaft 101*a*. The cylinder 103 accommodates the eccentrically rotating piston 102. The upper bearing 104 and the lower bearing 105 close the upper and lower opening surfaces of the cylinder 103. The vane 106 partitions a space formed from the cylinder 103, the piston 102, the upper bearing 104, and the lower bearing 105 into the suction chamber 113 and the compression chamber 114. The recessed portion 107 is recessed on a surface of the upper bearing 104 opposite to the cylinder 103. The discharge space 117 is formed by closing the recessed portion 107 with the cover 108. The discharge gas flows from the compression chamber 114 into the discharge space 117 and directly flows out to the outside of the rotary compressor 100. A volume of the discharge space 117 has 3 to 10 times the enclosed volume of the cylinder 103.

With this, the discharge space 117 acts as a buffer to attenuate the pressure pulsation generated by the opening and closing operation of the check valve 118. FIG. 4 shows a graph of a change in the pressure pulsation (non-dimensional with the pressure pulsation at Vc/Vs=10 as 1) with respect to a ratio Vc/Vs of spatial volume Vc of the discharge space 117 to the enclosed volume Vs of the cylinder 103 in our company's compressor. As shown in FIG. 4, in the range of Vc/Vs of 3 to 10, the pressure pulsation can be suppressed to up to approximately twice the near-limit value (Vc/Vs=10) at which the pressure pulsation can be suppressed. Therefore, low noise and low vibration of the rotary compressor 100 can be realized.

In addition, in the configuration where the discharge gas directly flows out from the discharge space 117 to the outside of the rotary compressor 100, the pressure in the discharge space 117 rises as soon as the discharge from the compression chamber 114 to the discharge space 117 starts, so the pressure in the compression chamber 114 also rises and over-compression tends to occur. However, in the configuration of the present invention, since the pressure pulsation in the discharge space 117 can be suppressed, the over-compression in the compression chamber 114 can also be suppressed accordingly. Therefore, the compression power in the compression chamber 114 can be reduced, and high efficiency of the rotary compressor 100 can be realized.

Furthermore, by sufficiently securing the width of the discharge space 117, a flow path cross-sectional area of the discharge gas flowing through the discharge space 117 can be made large. In addition, as shown in FIG. 3, by making the recessed portion 107 a simple shape, sudden expansion and contraction in the flow path inside the discharge space 117 can be eliminated. Therefore, pressure loss of the discharge gas in the discharge space 117 can be suppressed, and high efficiency of the rotary compressor 100 can be realized.

Moreover, by securing the spatial volume of the discharge space 117 with the recessed portion 107, it is not necessary to bulge the cover 108 into a convex shape, and the total height of the upper bearing 104 including the cover 108 can be suppressed. This allows the electric motor 111 to be fixed closer to the cylinder 103 side. It is possible to suppress the deflection of the drive shaft 101 during operation, which contributes to reducing sliding loss and suppressing abnormal sliding at the bearing portion, as well as downsizing the rotary compressor 100 by reducing its height, or improving efficiency by increasing the lamination thickness of the electric motor 111. Therefore, high efficiency, high reliability, and low cost of the rotary compressor 100 can be realized.

However, the larger the Vc/Vs, the greater a depth of the recessed portion 107 needs to be set. This increases the total height of the upper bearing 104, moving the electric motor 111 away from the cylinder 103, leading to deflection of the drive shaft 101 and upsizing of the rotary compressor 100.

From the above viewpoint, a range of 4 to 8 is more preferable for Vc/Vs.

By setting Vc/Vs to 4 or more, the pressure pulsation in the discharge space 117 can be reliably suppressed. In addition, by setting Vc/Vs to 8 or less, the electric motor 111 can be fixed as close to the cylinder 103 side as possible at a level where the pressure pulsation is not much different from the nearly suppressible limit (Vc/Vs=10). Therefore, low noise, low vibration, high efficiency, high reliability, and low cost can be realized in a well-balanced manner.

Second Embodiment

A second embodiment will be described below using FIG. 5.

[2-1. Configuration]

A rotary compressor 200 according to the second embodiment differs from the rotary compressor 100 according to the first embodiment in the point that it is composed of at least one cylinder 103, but rather two cylinders, an upper cylinder 2031 and a lower cylinder 2032, and a partition plate 222 is provided between them.

The entire interior of a hermetic container 209 is an intermediate pressure atmosphere between a primary suction pressure when the rotary compressor 200 first sucks in and a secondary discharge pressure when it finally discharges. An electric motor 211 is accommodated in the central portion of the hermetic container 209, and a compression mechanism 212 is accommodated in the lower portion thereof. The compression mechanism 212 is driven by a drive shaft 201 fixed to a rotor 211*a* of the electric motor 211. The internal space of the hermetic container 209 consists of an electric motor upper space 223 above the electric motor 211, an electric motor lower space 224 below the electric motor 211, and a compression mechanism lower space 225 below the compression mechanism 212. A passage penetrating in the axial direction is provided in the electric motor 211 and the compression mechanism 212, and the electric motor upper space 223, the electric motor lower space 224, and the compression mechanism lower space 225 are always communicating with each other.

The upper cylinder 2031, an upper piston 2021, and an upper vane (not shown) are sandwiched between an upper bearing 204 and the partition plate 222, and the lower cylinder 2032, a lower piston 2022, and the lower vane (not shown) are sandwiched between the partition plate 222 and a lower bearing 205. By partitioning the space formed between the upper and lower cylinders 2031, 2032 and the upper and lower pistons 2021, 2022 with the upper and lower vanes, upper and lower suction chambers 2131, 2132 and upper and lower compression chambers 2141, 2142 are formed. In this way, an upper compression element 2211 and a lower compression element 2212 perform compression operation.

The upper bearing 204 is provided with a recessed portion 207 and an upper discharge hole (not shown), and an upper discharge space 2171 is formed by closing the recessed portion 207 with the upper cover 2081. The upper discharge space 2171 communicates with an upper compression chamber 2141 through the upper discharge hole equipped with an upper check valve (not shown). The lower bearing 205 is provided with a lower discharge hole (not shown), and a lower discharge space 2172 is formed by closing the lower bearing 205 with a lower cover 2082. The lower discharge space 2172 communicates with the lower compression chamber 2142 through the lower discharge hole equipped with a lower check valve (not shown). The lower discharge space 2172 communicates with the electric motor lower space 224 through a lower discharge passage (not shown) penetrating in the axial direction from the upper cover 2081 to the lower bearing 205.

A primary suction pipe 2101 is inserted into the outer periphery of the lower cylinder 2032, and the primary suction pipe 2101 communicates with the lower suction chamber 2132 through a lower suction passage 2152. A primary discharge pipe 2191 is connected to the upper part of the hermetic container 209, and the primary discharge pipe 2191 communicates with the electric motor upper space 223. A secondary suction pipe 2102 is inserted into the upper bearing 204, and the secondary suction pipe 2102 communicates with the upper suction chamber 2131 through an upper suction passage 2151. The upper suction passage 2151 is composed of grooves provided in the upper bearing 204 and the upper cylinder 2031, respectively. A secondary discharge pipe 2192 is inserted into the upper bearing 204, and the secondary discharge pipe 2192 communicates with the upper discharge space 2171.

The upper cover 2081 partitions a primary discharge gas at the intermediate pressure inside the hermetic container 209 and a secondary discharge gas at high pressure inside the upper discharge space 2171. The lower cover 2082 partitions the primary discharge gas at the intermediate pressure immediately after being compressed by the lower compression element 2212 and an oil accumulated at the intermediate pressure in the compression mechanism lower space 225. The lower cover 2082 prevents the oil from flowing out of the rotary compressor 200 due to the primary discharge gas stirring the oil. The upper cover 2081, the upper bearing 204, the upper cylinder 2031, the partition plate 222, the lower cylinder 2032, the lower bearing 205, and the lower cover 2082 are fastened in the axial direction by a plurality of fastening bolts 220. A volume of the upper discharge space 2171 has 3 to 10 times the enclosed volume of the upper cylinder 2031.

[2-2. Operation]

An operation of the rotary compressor 200 configured as above will be described below.

[2-2-1. Compression Operation]

A compression operation of the compression mechanism 212 having the upper and lower compression elements 2211, 2212 of the rotary compressor 200 is similar to that of the rotary compressor 100 of the first embodiment. However, the upper and lower compression chambers 2141, 2142 perform compression in opposite phases.

The low-temperature and low-pressure primary suction gas sucked in from the primary suction pipe 2101 is sucked into the lower suction chamber 2132, compressed to the intermediate pressure by the lower compression element 2212, and then discharged into the lower discharge space 2172. This primary discharge gas at the intermediate pressure flows out into the electric motor lower space 224 through the lower discharge passage penetrating in the axial direction from the upper cover 2081 to the lower bearing 205. The primary discharge gas reaches the electric motor upper space 223 through the passage penetrating in the axial direction of the electric motor 211, and then flows into the refrigeration cycle through the primary discharge pipe 2191. The primary discharge gas passes through the gas cooler of the refrigeration cycle, is mixed with the refrigerant from the injection circuit, and is sucked into the upper suction chamber 2131 as the secondary suction gas at the intermediate pressure from the secondary suction pipe 2102. The primary discharge gas is compressed to the secondary discharge pressure which is finally discharged from the rotary compressor 200, by the upper compression element 2211, and then discharged into the upper discharge space 2171. This secondary discharge gas directly flows out to the outside of the rotary compressor 200 through the secondary discharge pipe 2192. The secondary discharge gas passes through the condenser of the refrigeration cycle and then branches into the injection circuit and the evaporator circuit. The refrigerant in the evaporator circuit passes through the evaporator and is sucked in from the primary suction pipe 2101 as the low-pressure primary suction gas. By incorporating such an injection circuit into the refrigeration cycle, the refrigeration cycle capacity can be improved by reducing the enthalpy at the inlet of the evaporator, improving the heat exchange efficiency, etc., and further capacity improvement is possible by combining it with an economizer. At the same time, effects such as reducing the temperature of the secondary discharge gas of the rotary compressor 200 and improving the efficiency of the refrigeration cycle can also be obtained.

The rotary compressor 100 of the first embodiment is a single-stage compression type that compresses from the suction pressure to the discharge pressure with one compression element 121. On the other hand, the rotary compressor 200 of the second embodiment is a two-stage compression type that sequentially compresses with the lower compression element 2212 and the upper compression element 2211.

[2-2-2. Oil Supply Operation]

An oil supply operation of the rotary compressor 200 is generally similar to that of the rotary compressor 100 according to the first embodiment. However, for reliable oil supply of the upper compression element 2211, the compression mechanism lower space 225 where an oil accumulates and the upper suction passage 2151 are communicated by a small hole 226 to further supply the oil to the upper suction chamber 2131.

An oil mist is supplied for lubrication and sealing in the lower compression element 2212 and flows out into the electric motor lower space 224 together with the primary discharge gas. The oil mist is separated from the gas and liquefied before reaching the primary discharge pipe 2191 together with the flow of the primary discharge gas described above, and returns to the compression mechanism lower space 225 at the bottom of the hermetic container 209 by gravity.

[2-3. Effects, Etc.]

As described above, in the present embodiment, the rotary compressor 200 includes the upper compression element 2211, the lower compression element 2212, and the partition plate 222. The partition plate 222 is provided between the upper and lower compression elements 2211, 2212. The upper suction chamber 2131 and the upper compression chamber 2141 are formed by closing the upper and lower opening surfaces of the upper cylinder 2031 with the upper bearing 204 supporting the drive shaft 201 above and the partition plate 222. The lower suction chamber 2132 and the lower compression chamber 2142 are formed by closing the upper and lower opening surfaces of the lower cylinder 2032 with the lower bearing 205 supporting the drive shaft 201 below and the partition plate 222. The refrigerant compressed by the lower compression element 2212 as the first compression element is further compressed by the upper compression element 2211 as the second compression element, discharged into the upper discharge space 2171, and directly flows out to the outside of the rotary compressor 200. A volume of the upper discharge space 2171 has 3 to 10 times the enclosed volume of the upper cylinder 2031.

The hermetic container 209 in the present embodiment is a so-called intermediate pressure container with an intermediate pressure atmosphere between the primary suction pressure and the secondary discharge pressure. The intermediate pressure container has an advantage that the pressure-resistant structure can be simplified compared with the high-pressure container with a high-pressure secondary discharge gas atmosphere. In such an intermediate pressure container, the secondary discharge gas directly flows out from the upper discharge space 2171 to the outside of the rotary compressor 200, which tends to cause pressure pulsation in the upper discharge space 2171. Therefore, as in the rotary compressor 100 of the first embodiment, the effects of suppressing pressure pulsation and over-compression are easily exhibited, and at the same time, it is easy to suppress pressure loss in the upper discharge space 2171 and fix the electric motor 211 closer to the upper cylinder 2031. Therefore, low noise, low vibration, high efficiency, high reliability, and low cost of the rotary compressor 200 can be realized simultaneously.

In addition, by having the upper compression element 2211 and the lower compression element 2212 perform compression in opposite phases, torque fluctuations can be made smaller compared with the rotary compressor 100 of the first embodiment. Therefore, low noise and low vibration of the rotary compressor 200 can be realized.

In the present embodiment, the rotary compressor 200 may have a ratio R/t of 1.5 or less between an average fastening portion radius R, that is an average value of the distance from the center axis of the drive shaft 201 to the center axis of the plurality of fastening bolts 220, and an average thickness fastening portion t, that is an average value of the thickness of the upper bearing 204 at the position of the fastening bolt 220.

With this, a depth of the recessed portion 207 is set sufficiently large to secure the volume of the upper discharge space 2171, thereby further suppressing the pressure pulsation in the upper discharge space 2171. At the same time, the strength of the upper bearing 204 as the upper end plate closing the upper opening surface of the upper cylinder 2031 can be increased. By increasing the strength of the upper bearing 204, the fastening strain of the upper bearing 204 caused by the fastening axial force of the fastening bolts 220 when the upper bearing 204 and the upper cylinder 2031 are fastened together, and the pressure strain caused by the pressure difference applied to the entire upper bearing 204 are reduced. The effect of stably keeping the fastening surface of the upper bearing 204 and the upper cylinder 2031 in close contact and the effect of stably maintaining the small axial gap above and below the upper piston 2021 are obtained. As a result, the effect of stably keeping the fastening surface in close contact can reduce refrigerant leakage between the internal space of the hermetic container 209 and the upper suction chamber 2131 and the upper compression chamber 2141. In addition, by the effect of stably maintaining the axial gap of the upper piston 2021, variations in the lubrication state at the sliding portion of the upper and lower surfaces of the upper piston 2021 and variations in the oil supply of the upper compression chamber 2141 and the upper suction chamber 2131 can be suppressed, and the lubrication and sealing inside the upper compression element 2211 can be stabilized. Therefore, high efficiency and high reliability of the rotary compressor 200 can be realized by reducing refrigerant leakage and stabilizing lubrication and sealing.

According to present embodiment, the rotary compressor 200 may use carbon dioxide as the working fluid.

As a result, the operating pressure and pressure difference are larger than those of HFC refrigerant, HC refrigerant, and HFO refrigerant. Therefore, by adopting the two-stage compression type, a pressure-resistant design of the hermetic container 209 can be performed according to the intermediate pressure of a primary discharge pressure instead of the ultra-high pressure of the secondary discharge pressure, which can particularly suppress the cost of the hermetic container 209. In addition, the pressure difference between the suction gas and the discharge gas in each of the upper and lower compression elements 2211, 2212 is smaller than that of the single-stage compression type, so the backflow of refrigerant gas from the upper and lower compression chambers 2141, 2142 to the upper and lower suction chambers 2131, 2132 can be minimized to reduce leakage loss. Furthermore, it is possible to suppress pressure deformation of component parts such as the upper bearing 204 and the lower bearing 205, stabilize gaps in each part, reduce refrigerant leakage at the fastening surface, and improve lubricity of the sliding portions. Therefore, high efficiency and high reliability of the rotary compressor 200 can be realized.

The enclosed volume Vsu of the upper compression element 2211 is more preferably in the range of 10 cc to 50 cc.

When using high-pressure refrigerant carbon dioxide as the working fluid, the refrigerant pipes connected to the rotary compressor 200 are generally increased in diameter with common materials. And then, the pressure resistance performance cannot be maintained, which makes it difficult to realize, and small-diameter refrigerant pipes must be used. However, in this case, the large flow rate of the secondary discharge gas from the upper compression element 2211 with the enclosed volume Vsu of 10 cc or more is likely to cause pressure loss in the refrigerant pipes, which promotes a decrease in efficiency and an increase in pressure pulsation in the upper discharge space 2171. Especially in such a rotary compressor 200 using carbon dioxide as the working fluid, the effects of the present invention can be exhibited to more reliably realize low noise, low vibration, high efficiency, high reliability, and low cost simultaneously.

The ratio Vsu/Vsl of the enclosed volumes Vsu, Vsl of the upper compression element 2211 and the lower compression element 2212 is more preferably in the range of 0.7 to 1.2.

In the case where there is no injection from the injection circuit to the upper compression element 2211, in the rotary compressor 200 with Vsu/Vsl set to 0.7, the compression ratio at which the two-stage compression type functions, that is, the compression ratio at which the secondary suction pressure can be maintained at the intermediate pressure between the low-pressure primary suction pressure and the high-pressure secondary discharge pressure, is $1/0.7 \fallingdotseq 1.4$. In other words, the two-stage compression type functions at a compression ratio of 1.4 or higher. Since the compression ratio under normal operating conditions is generally 1.4 or higher for any refrigerant, Vsu/Vsl may be 0.7 or higher. On the other hand, when injecting from the injection circuit to the upper compression element 2211 for the purpose of improving the refrigeration cycle capacity, the secondary suction pressure becomes higher. Therefore, Vsu/Vsl needs to be set larger, and if Vsu/Vsl is about 1.2, the refrigerant can be distributed in a well-balanced manner to the evaporator circuit and the injection circuit, and the efficiency of the refrigeration cycle can be maintained high. Therefore, by maintaining the secondary suction pressure at the intermediate pressure, the compression torques of the upper and lower compression elements 2211, 2212 are secured to some extent. By doing so, the bias of the upper and lower compression torques can be suppressed, and the vibration and deterioration of reliability of the rotary compressor 200 due to torque fluctuations can be suppressed. At the same time, the biases of the pressure difference between the upper suction chamber 2131 and the upper compression chamber 2141 in the upper compression element 2211 and the pressure difference between the lower suction chamber 2132 and the lower compression chamber 2142 in the lower compression element 2212 can be suppressed, and the deterioration of leakage loss from the upper and lower compression chambers 2141, 2142 to the upper and lower suction chambers 2131, 2132 can be suppressed. Therefore, low noise, low vibration, high efficiency, and high reliability can be realized.

Third Embodiment

A third embodiment will be described below using FIG. 6.

[3-1. Configuration]

A rotary compressor 300 of the third embodiment differs from the rotary compressor 200 of the second embodiment in that at least a primary suction pipe 3101 is connected to an upper compression element 3211, and a secondary suction pipe 3102 and a secondary discharge pipe 3192 are connected to a lower compression element 3212.

An upper bearing 304 is provided with an upper discharge hole (not shown) and an upper check valve (not shown), and an upper compression chamber 3141 communicates with an electric motor lower space 324. A lower bearing 305 is provided with a recessed portion 307 and a lower discharge hole (not shown), and a lower discharge space 3172 is formed by closing the recessed portion 307 with a lower cover 3082. The lower discharge space 3172 communicates with a lower compression chamber 3142 through the lower discharge hole equipped with a lower check valve (not shown). To secure a large volume of the lower discharge space 3172, the lower cover 3082 is bulged into a convex shape.

The primary suction pipe 3101 is inserted into the outer periphery of an upper cylinder 3031, and the primary suction pipe 3101 communicates with an upper suction chamber 3131. A primary discharge pipe 3191 is connected to an upper part of a hermetic container 309, and the primary discharge pipe 3191 communicates with an electric motor upper space 323. The secondary suction pipe 3102 is inserted into the lower bearing 305, and the secondary suction pipe 3102 communicates with a lower suction chamber 3132 through a lower suction passage 3152. The lower suction passage 3152 is composed of grooves provided respectively in the lower bearing 305 and a lower cylinder 3032. The secondary discharge pipe 3192 is inserted into the lower bearing 305, and the secondary discharge pipe 3192 communicates with the lower discharge space 3172.

The lower cover 3082 partitions the primary discharge gas at the intermediate pressure inside the hermetic container 309 and a secondary discharge gas at high pressure inside the lower discharge space 3172. The upper bearing 304, the upper cylinder 3031, a partition plate 322, the lower cylinder 3032, the lower bearing 305, and the lower cover 3082 are fastened in the axial direction by a plurality of fastening bolts 320. A volume of the lower discharge space 3172 has 3 to 10 times the enclosed volume of the lower cylinder 3032.

[3-2. Operation]

An operation of the rotary compressor 300 configured as above will be described below.

[3-2-1. Compression Operation]

A compressing operation of a compression mechanism 312 having the upper and lower compression elements 3211, 3212 of the rotary compressor 300 is a two-stage compression type similar to that of the rotary compressor 200 of the second embodiment. However, in the rotary compressor 200 of the second embodiment, two-stage compression is performed in the order of the lower compression element 2212 and the upper compression element 2211. On the other hand, in the rotary compressor 300 of the third embodiment, two-stage compression is performed in the order of the upper compression element 3211 and the lower compression element 3212.

[3-2-2. Oil Supply Operation]

An oil supply operation of the rotary compressor 300 is similar to that of the rotary compressor 200 of the second embodiment. However, the order of the upper and lower compression elements 3211, 3212 of the rotary compressor 300 is opposite to that of the rotary compressor 200 according to the second embodiment. Accordingly, for reliable lubrication of the lower compression element 3212, a compression mechanism lower space 325 where oil accumulates and the lower suction passage 3152 are communicated by a small hole 326 to further supply oil to the lower suction chamber 3132.

[3-3. Effect and the Like]

As described above, in this embodiment, the rotary compressor 300 includes the upper compression element 3211, the lower compression element 3212, and the partition plate 322. The partition plate 322 is provided between the upper and lower compression elements 3211 and 3212. The upper suction chamber 3131 and the upper compression chamber 3141 are formed by closing the upper and lower opening surfaces of the upper cylinder 3031 with the upper bearing 304 supporting a drive shaft 301 at the upper side and the partition plate 322. The lower suction chamber 3132 and the lower compression chamber 3142 are formed by closing the upper and lower opening surfaces of the lower cylinder 3032 with the lower bearing 305 supporting the drive shaft 301 at the lower side and the partition plate 322. The refrigerant compressed by the upper compression element 3211 as the first compression element is further compressed by the lower compression element 3212 as the second compression element, discharged into the lower discharge space 3172, and directly flows out to the outside of the rotary compressor 300. A volume of the lower discharge space 3172 has 3 to 10 times the enclosed volume of the lower cylinder 3032.

With this, the same effects as those of the second embodiment can be obtained, and at the same time, the volume of the lower discharge space 3172 is secured by bulging the lower cover 3082 downward into a convex shape. Therefore, the total height of the upper bearing 304 can be suppressed, and an electric motor 311 can be fixed closer to the upper cylinder 3031 side, which makes it possible to suppress the deflection of the drive shaft 301 during operation, reduce sliding loss and suppress abnormal sliding at the bearing portion. At the same time, it can contribute to downsizing the rotary compressor 300 by reducing its height or improving efficiency by increasing the lamination thickness of the electric motor 311. Therefore, low noise, low vibration, high efficiency, high reliability, and low cost of the rotary compressor 300 can be realized simultaneously.

In addition, in the normal operating state, the oil level of the oil accumulated in the compression mechanism lower space 325 hardly reaches the electric motor lower space 324. Therefore, the primary discharge gas compressed by the upper compression element 3211 can be discharged directly into the electric motor lower space 324 without the oil flowing out of the rotary compressor 300. And the upper cover for partitioning the primary discharge gas and the oil is unnecessary. Therefore, low cost of the rotary compressor 300 can be realized.

Other Embodiments

As described above, the first to third embodiments are described as examples of techniques disclosed in the present application. However, the technique in this disclosure is not limited to this, and can also be applied to embodiments in which changes, substitutions, additions, omissions, etc. are made. In addition, it is also possible to combine the components described in the above first to third embodiments to create new embodiments.

Therefore, other embodiments will be exemplified below.

In the first to third embodiments, a single-cylinder rotary compressor 100 and two-cylinder rotary compressors 200 and 300 were described as examples of the rotary compressor. A rotary compressor may be any compressor that compresses gas. Therefore, the rotary compressor is not limited to the single-cylinder rotary compressor 100 or the two-cylinder rotary compressors 200 and 300. However, if the single-cylinder rotary compressor 100 or the two-cylinder rotary compressors 200 or 300 are used, a balance between cost, efficiency and reliability is good, and there is an advantage that mass production is easy.

In the second embodiment, carbon dioxide was described as an example of the working fluid. The working fluid may be any compressible fluid. Therefore, the working fluid is not limited to carbon dioxide. However, if this is used, the operating pressure and pressure difference are larger than those of HFC refrigerant, HC refrigerant, and HFO refrigerant. Therefore, by adopting the two-stage compression type, the pressure-resistant design of the hermetic container 209 can be performed according to an intermediate pressure of the primary discharge pressure instead of an ultra-high pressure of the secondary discharge pressure, which can suppress a cost of the hermetic container 209. In addition, the pressure difference between the suction gas and the discharge gas in each of the upper and lower compression elements 2211, 2212 is smaller than that of the single-stage compression type, so the backflow of refrigerant gas from the upper and lower compression chambers 2141, 2142 to the upper and lower suction chambers 2131, 2132 can be minimized to reduce leakage loss. Furthermore, it is possible to suppress pressure deformation of component parts such as the upper bearing 204 and the lower bearing 205, stabilize gaps in each part, reduce refrigerant leakage at the fastening surface, and improve lubricity of the sliding portions. Also, if a mixed refrigerant of HFC refrigerant, HC refrigerant, or HFO refrigerant and carbon dioxide is used as the working fluid, the temperature glide between the inlet and outlet of the condenser of the refrigeration cycle can be suppressed. Therefore, the decrease in heat exchange efficiency of the condenser can be suppressed.

In the third embodiment, a volume of the lower discharge space 3172 has 3 to 10 times the enclosed volume of the lower cylinder 3032. As an example of the configuration of the lower discharge space 3172, the configuration of forming the lower discharge space 3172 by the lower cover 3082 inflated into a convex shape and the recessed portion 307 of the lower bearing 305 is described. A volume of the lower discharge space 3172 may have 3 to 10 times the enclosed volume of the lower cylinder 3032. Therefore, it is not limited to the above configuration. However, if this is used, the shape of the lower cover 3082 can be freely designed within the range of the compression mechanism lower space 325, and the volume of the lower discharge space 3172 can be secured to minimize pressure pulsation. In addition, the lower cover 3082 may be made flat, and the average thickness t of the fastening portion of the lower bearing 305 may be designed sufficiently large. By doing so, the depth of the recessed portion 307 can be increased to form the large-volume lower discharge space 3172. If this is used, the ratio R/t between the average fastening portion radius R and the average fastening portion thickness t of the lower bearing 305 can be surely set to 1.5 or less. And by increasing the strength of the lower bearing 305, the fastening strain and the pressure strain are reduced, and the effect of stably keeping the fastening surface in close contact and the effect of stably maintaining the axial gap of a lower piston 3022 are obtained. Therefore, high efficiency and high reliability of the rotary compressor 300 can be realized by reducing refrigerant leakage and stabilizing lubrication and sealing.

In the third embodiment, the primary discharge gas compressed by the upper compression element 3211 is discharged. As an example of the configuration, a configuration for directly discharging it into the electric motor lower space 324 was described. The primary discharge gas compressed by the upper compression element 3211 may be discharged into the internal space of the hermetic container 309. Therefore, it is not limited to the above configuration. However, if this is used, the upper cover for partitioning the primary discharge gas and the oil is unnecessary, so low cost of the rotary compressor 300 can be realized. In addition, an upper cover may be provided. If this is used, the operating sound of the upper check valve is blocked by the upper cover, so low noise of the rotary compressor 300 is possible. At the same time, even in an operating state where the oil level is high, such as when the rotary compressor 300 is started from a state where the refrigerant is liquefied and mixed with the oil at low outside air temperature, the so-called sleeping state, the upper cover can prevent the primary discharge gas from stirring up the oil and suppress the oil from flowing out of the rotary compressor 300. Therefore, low noise and high reliability of the rotary compressor 300 can be realized.

The above-described embodiments are for exemplifying the techniques of the disclosure, and various changes, substitutions, additions, omissions, etc. can be made within the scope of the claims and their equivalents.

INDUSTRIAL APPLICABILITY

The present disclosure is applicable to a rotary compressor in which pressure pulsation occurs in the discharge space. Specifically, the present disclosure is applicable to air conditioners, refrigerators, water heaters, etc. using natural refrigerant carbon dioxide, or HFC refrigerant, HCFC refrigerant, HC refrigerant, HFO refrigerant.

DESCRIPTION OF SYMBOLS

100 Rotary compressor
101 Drive shaft
**101*a*** Eccentric shaft
102 Piston
**102*a*** Inner periphery
103 Cylinder
104 Upper bearing (upper end plate)
105 Lower bearing (lower end plate)
106 Vane
107 Recessed portion
108 Cover
109 Hermetic container
110 Suction pipe
111 Electric motor
**111*a*** Rotor
112 Compression mechanism
113 Suction chamber
114 Compression chamber
115 Suction passage
**115*a*** Vertical hole
**115*b*** Groove
116 Discharge hole
117 Discharge space
118 Check valve
119 Discharge pipe
120 Fastening bolt
121 Compression element
200 Rotary compressor
201 Drive shaft
2021 Upper piston
2022 Lower piston
2031 Upper cylinder
2032 Lower cylinder
204 Upper bearing
205 Lower bearing
207 Recessed portion
2081 Upper cover
2082 Lower cover
209 Hermetic container
2101 Primary suction pipe
2102 Secondary suction pipe

211 Electric motor
211*a* Rotor
212 Compression mechanism
2131 Upper suction chamber
2132 Lower suction chamber
2141 Upper compression chamber
2142 Lower compression chamber
2151 Upper suction passage
2152 Lower suction passage
2171 Upper discharge space
2172 Lower discharge space
2191 Primary discharge pipe
2192 Secondary discharge pipe
220 Fastening bolt
2211 Upper compression element
2212 Lower compression element
222 Partition plate
223 Electric motor upper space
224 Electric motor lower space
225 Compression mechanism lower space
226 Small hole
300 Rotary compressor
301 Drive shaft
3021 Upper piston
3022 Lower piston
3031 Upper cylinder
3032 Lower cylinder
304 Upper bearing
305 Lower bearing
307 Recessed portion
3082 Lower cover
309 Hermetic container
3101 Primary suction pipe
3102 Secondary suction pipe
311 Electric motor
312 Compression mechanism
3131 Upper suction chamber
3132 Lower suction chamber
3141 Upper compression chamber
3142 Lower compression chamber
3152 Lower suction passage
3172 Lower discharge space
3191 Primary discharge pipe
3192 Secondary discharge pipe
320 Fastening bolt
3211 Upper compression element
3212 Lower compression element
322 Partition plate
323 Electric motor upper space
324 Electric motor lower space
325 Compression mechanism lower space
326 Small hole

The invention claimed is:

1. A rotary compressor comprising:

a drive shaft with an eccentric shaft;

a piston fitted onto the eccentric shaft;

a cylinder that accommodates the eccentrically rotating piston;

an upper end plate and a lower end plate that close upper and lower opening surfaces of the cylinder;

a vane that divides a space formed by the cylinder, the piston, the upper end plate, and the lower end plate into a suction chamber and a compression chamber; and a discharge space that is formed by causing a cover to close a recessed portion obtained by recessing a surface of either the upper end plate or the lower end plate on an opposite side to the cylinder and where discharge gas flows in from the compression chamber and directly flows out to outside of the compressor, wherein spatial volume of the recessed portion of the discharge space is set to 3 to 10 times enclosed volume of the cylinder.

2. The rotary compressor according to claim 1, wherein the upper end plate or the lower end plate having the discharge space is axially fastened together with the cylinder by a plurality of fastening bolts, and a ratio R/t between an average fastening portion radius R, that is an average value of a distance from a center axis of the drive shaft to a center axis of the fastening bolts, and an average fastening portion thickness t, that is an average value of a thickness of the upper end plate or the lower end plate at a position of the fastening bolt, is 1.5 or less.

3. The rotary compressor according to claim 1, further comprising:

a first compression element and a second compression element consisting of a plurality of the cylinders, the pistons, and the vanes; and a partition plate provided between the first compression element and the second compression element, wherein the drive shaft is supported by an upper bearing and a lower bearing at a top and a bottom, and the partition plate is configured as the upper end plate or the lower end plate, and refrigerant compressed by the first compression element is further compressed by the second compression element and discharged into the discharge space, and directly flows out to the outside of the compressor.

4. The rotary compressor according to claim 1, wherein carbon dioxide is used as a working fluid.

* * * * *